US011330873B2

(12) United States Patent
Wang

(10) Patent No.: US 11,330,873 B2
(45) Date of Patent: May 17, 2022

(54) CLIP-ON BELT BUCKLE

(71) Applicant: Wei Wang, Jiangxi (CN)

(72) Inventor: Wei Wang, Jiangxi (CN)

( * ) Notice: Subject to any disclaimer, the term of this patent is extended or adjusted under 35 U.S.C. 154(b) by 0 days.

(21) Appl. No.: 17/185,946

(22) Filed: Feb. 25, 2021

(65) Prior Publication Data

US 2021/0274891 A1 Sep. 9, 2021

Related U.S. Application Data

(63) Continuation of application No. PCT/CN2019/099529, filed on Aug. 6, 2019.

(30) Foreign Application Priority Data

Aug. 29, 2018 (CN) ..... 201810991987.6

(51) Int. Cl.
*A44B 11/06* (2006.01)
*A44B 11/00* (2006.01)
*A44B 11/10* (2006.01)

(52) U.S. Cl.
CPC ..... *A44B 11/06* (2013.01); *A44B 11/006* (2013.01); *A44B 11/10* (2013.01)

(58) Field of Classification Search
CPC ..... A44B 11/006; A44B 11/08; A44B 11/06; A44B 11/10; Y10T 24/4053; Y10T 24/4079; Y10T 24/4019
See application file for complete search history.

(56) References Cited

U.S. PATENT DOCUMENTS

| | | | | | |
|---|---|---|---|---|---|
| 1,089,853 | A * | 3/1914 | Meserole | A44B 11/10 | 24/194 |
| 1,347,324 | A | 7/1920 | Crandall | | |
| 1,381,353 | A * | 6/1921 | Shields | A44B 11/08 | 24/194 |
| 1,408,281 | A * | 2/1922 | Failey | A44B 11/08 | 2/322 |
| 1,511,903 | A * | 10/1924 | Myers | A44B 11/08 | 24/163 R |

FOREIGN PATENT DOCUMENTS

| | | | |
|---|---|---|---|
| CN | 203058565 | U | 7/2013 |
| CN | 107788621 | A | 3/2018 |
| WO | 2008068650 | A1 | 6/2008 |
| WO | 2010032210 | A1 | 3/2010 |

* cited by examiner

*Primary Examiner* — Robert Sandy

(57) ABSTRACT

A clip-on belt buckle, including a buckle part and a connecting part. A fixed end of a belt is fixedly connected to the connecting part. The buckle part includes a buckle body, a first clamp plate and a second clamp plate. An upper end and a lower end of the buckle body are provided with an oblique hole, respectively. An upper part and a lower part of a back of the buckle body are provided with a sliding groove, respectively. Centers of an upper end and a lower end of the first plate are provided with an elongated hole along a front-and-back direction, respectively. A vertical shaft is provided at a middle of the second plate. Two ends of the vertical shaft extend through the elongated holes, and then extend through the oblique holes. A movable end of the belt is inserted between the first plate and the second plate.

1 Claim, 6 Drawing Sheets

CLIP-ON BELT BUCKLE

CROSS-REFERENCE TO RELATED APPLICATIONS

This application is a continuation of International Patent Application No. PCT/CN2019/099529, filed on Aug. 6, 2019, which claims the benefit of priority from Chinese Patent Application No. 201810991987.6, filed on Aug. 29, 2018. The content of the aforementioned applications, including any intervening amendments thereto, is incorporated herein by reference in its entirety.

TECHNICAL FIELD

This application relates to belt buckles of belts for fastening trousers, and more particularly to a clip-on belt buckle.

BACKGROUND

The existing belt buckles usually include pin-type buckle, plate-type buckle, automatic buckle and roller-type buckle. The pin-type buckle and the plate-type buckle may cause obvious damage to the belt holes, and a tightness of the fastening cannot be accurately adjusted. The automatic buckle cannot bear a relatively large pulling force, and the fastening performance is less preferable. The roller-type buckle damages the belt greatly, and after a long time of use, the belt cannot be buckled due to the abrasion.

SUMMARY

In order to overcome the defects that the existing belt buckles will greatly damage belts during the buckling and they cannot provide a desirable fastening performance, the present disclosure provides a clip-on belt buckle, in which two large-area clamp plates are provided to clamp a belt from the front and the back, and the fastening and releasing of the belt is realized by sliding the two clamp plates to the right or to the left in a first sliding groove and a second sliding groove at a rear portion of a buckle body. There is no sliding friction between the clamp plates and the belt. The force of the clamp plate on the belt is large, whereas the pressure is small, and the belt is fastened by a large static friction.

The technical solutions of the present disclosure are described as follows.

A clip-on belt buckle, comprising:

a buckle part;

a connecting part; and a pin shaft;

wherein a fixed end of a belt is fixed on the connecting part; the buckle part is movably connected to the connecting part by the pin shaft; the buckle part comprises a buckle body; a first elongated hole is provided at an upper end of the buckle body; a second elongated hole is provided at a lower end of the buckle body; an axis of the first elongated hole is oblique along a left-and-right direction; an axis of the second elongated hole is oblique along the left-and-right direction; an end of the first elongated hole close to the pin shaft is close to a human body in use; an end of the second elongated hole close to the pin shaft is close to the human body in use; a first sliding groove is provided on an upper part of a back of the buckle body; a second sliding groove is provided on an lower part of the back of the buckle body; the first sliding groove and the second sliding groove have the same width and are arranged along the left-and-right direction;

a first clamp plate is arranged behind the buckle body; a third elongated hole is arranged at a middle of an upper end of the first clamp plate; a fourth elongated hole is arranged at a middle of a lower end of the first clamp plate; an axis of the third elongated hole is arranged along a front-and-back direction; an axis of the fourth elongated hole is arranged along the front-and-back direction; the upper end of the first clamp plate is embedded in the first sliding groove and is slidable along the left-and-right direction; the lower end of the first clamp plate is embedded in the second sliding groove and is slidable along the left-and-right direction; a front surface of the first clamp plate abuts against a back surface of the buckle body and is slidable along the left-and-right direction; a second clamp plate is arranged behind the first clamp plate; a vertical shaft is arranged at a middle of the second clamp plate; an upper end of the vertical shaft is inserted into the third elongated hole and the first elongated hole; a lower end of the vertical shaft is inserted into the fourth elongated hole and the second elongated hole; the vertical shaft, the third elongated hole and the fourth elongated hole are together configured to control the first clamp plate and the second clamp plate to slide synchronously in the first sliding groove and the second sliding groove; the vertical shaft, the first elongated hole and the second elongated hole are together configured to control the second clamp plate to move close to or away from the first clamp plate during a synchronous sliding along the left-and-right direction;

when the belt is fastened, a movable end of the belt is inserted between the first clamp plate and the second clamp plate from right to left by means of a right hand of a user, and a tightness of the fastening is adjusted; the vertical shaft is slid to the right by a hand, such that the first clamp plate and the second clamp plate clamps the belt to slide synchronously to the right in the first sliding groove and the second sliding groove; meanwhile, the vertical shaft moves forward along the first elongated hole and the second elongated hole to drive the second clamp plate to move forward such that the second clamp plate and the first clamp plate clamp the belt;

when the belt is untied, the buckle body is fixed by the right hand, and the movable end of the belt is pulled to the left by a left hand, such that the belt drives the first clamp plate and the second clamp plate to slide synchronously to the left along the first sliding groove and the second sliding groove; meanwhile, the vertical shaft moves backward in the first elongated hole and the second elongated hole to drive the second clamp plate to move backward such that the second clamp plate and the first clamp plate are separated; then the buckle body is held by the left hand, and the movable end of the belt is pulled out from between the first clamp plate and the second clamp plate by the right hand.

The beneficial effects of the present disclosure are described as follows.

The clip-on belt buckle provided herein enables free and rapid adjustment of the fastening tightness of a belt. In the belt buckle, two clamp plates with a large area are arranged, which can exert a large force and static friction on the belt such that the belt is firmly fastened by the belt buckle. In addition, the pressure of the clamp plates on the belt is small, avoiding damaging the belt. In the case of using the belt buckle provided herein, the belt does not need to be punched and equipped with toothed chains.

BRIEF DESCRIPTION OF THE DRAWINGS

The present disclosure will be further described below with reference to the embodiment(s) and the accompany drawings.

Figure 1:
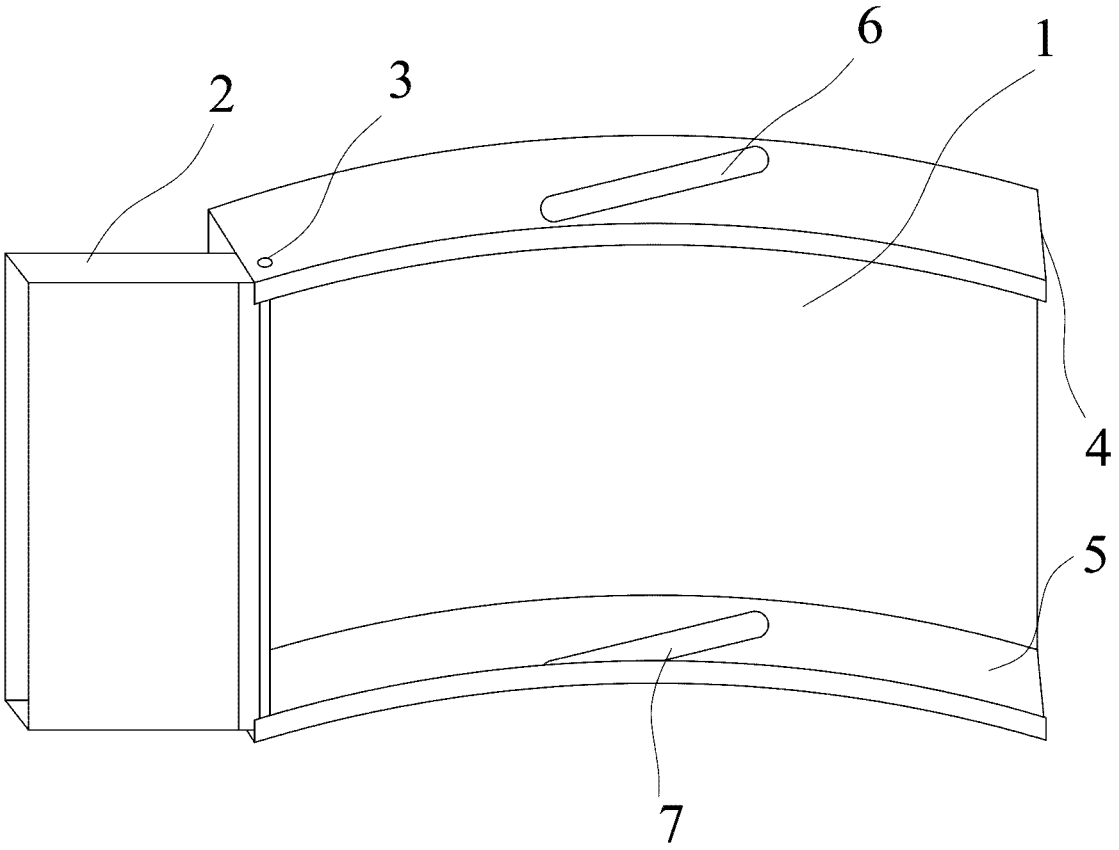
FIG. 1 schematically depicts a structure of a buckle body and a connection between the buckle body and a connecting part.

In the drawings, 1, buckle body; 2, connecting part; 3, pin shaft; 4, first sliding groove; 5, second sliding groove; 6, first elongated hole; 7, second elongated hole; 8, first clamp plate; 9, third elongated hole; 10, fourth elongated hole; 11, second clamp plate; 12, vertical shaft; and 13, belt.

DETAILED DESCRIPTION OF EMBODIMENTS

Embodiment 1

A clip-on belt buckle is made of a material selected from the group consisting of stainless steel, copper, zinc alloy and a combination thereof. In this embodiment, the clip-on belt buckle is made of stainless steel.

The "front" and "back" mentioned in the description respectively refer to a position far away from the abdomen of the human body and a position close to the abdomen of the human body when a belt is fastened or untied. The "right" and "left" refer to the right side and the left side of human body, respectively. The Y axis is along an up-and-down direction, and the X axis is long a left-and-right direction.

Figure 5:
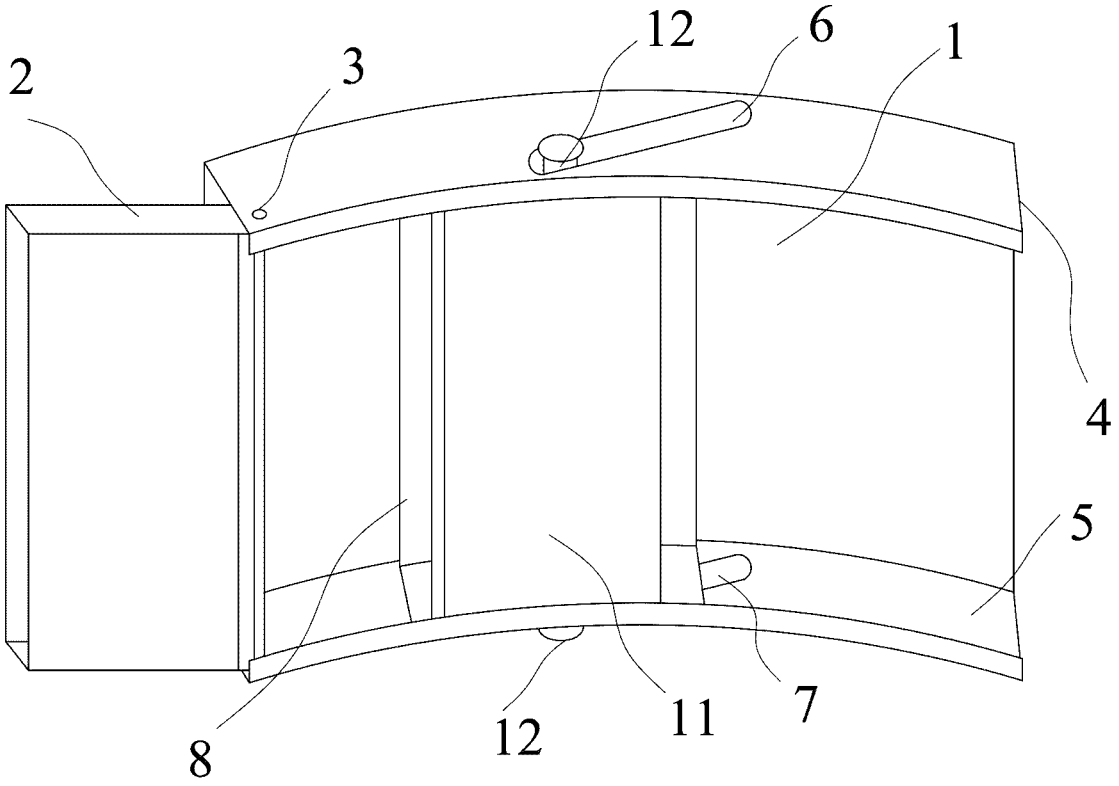
FIG. 5 schematically depicts a combination of the buckle body, the first clamp plate and the second clamp plate of a buckle part and a connection of the buckle body, the first clamp plate, the second clamp plate and the connecting part.
Figure 6:
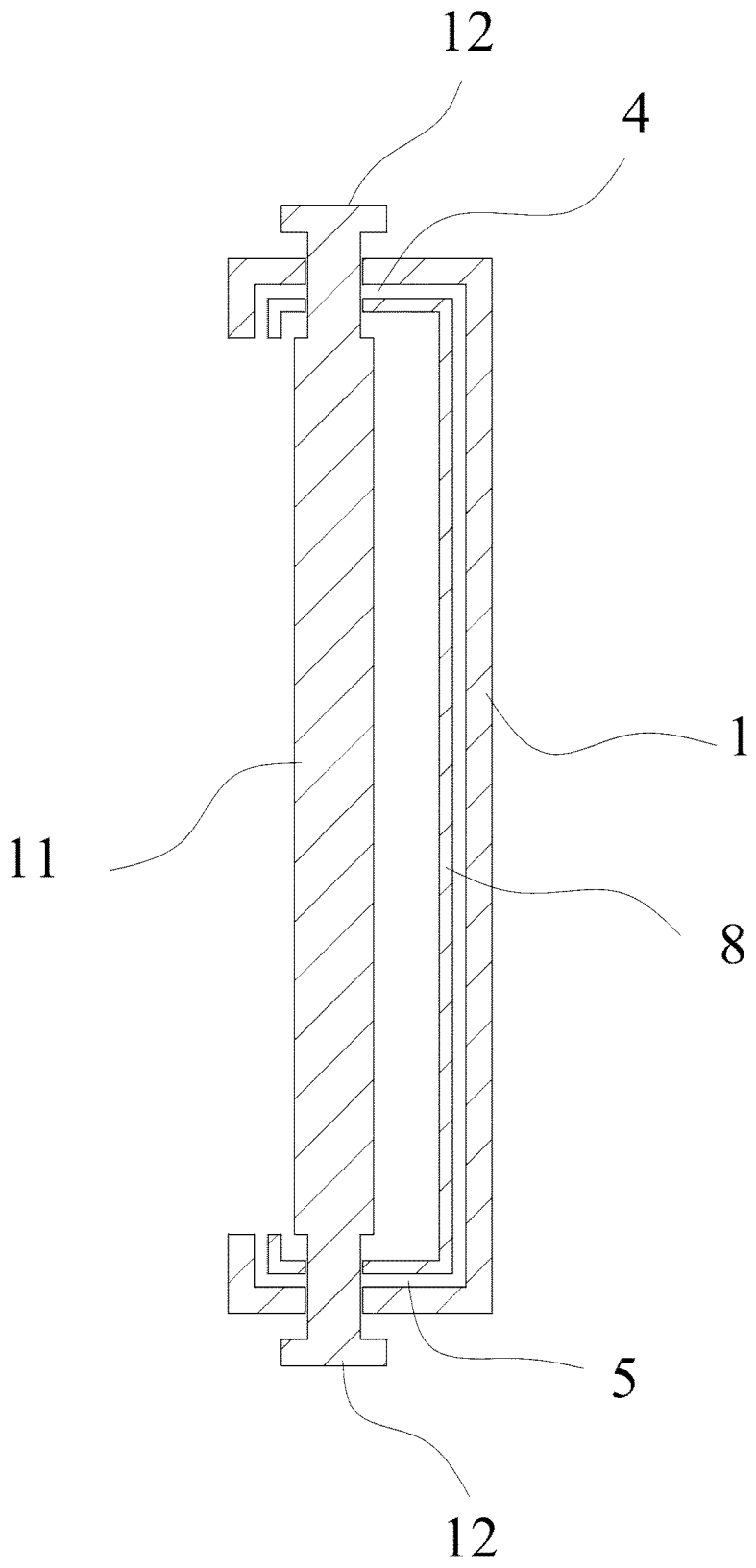
FIG. 6 is a side view of the combination of the buckle body, the first clamp plate and the second clamp plate of the buckle part.

The clip-on belt buckle includes a buckle part, a connecting part 2 and a pin shaft 3. A fixed end of a belt 13 is fixed on the connecting part 2. As shown in FIG. 6, the buckle part includes a buckle body 1, a first clamp plate 8 and a second clamp plate 11. As shown in FIGS. 1 and 5, the buckle body 1 is movably connected to the connecting part 2 by the pin shaft 3.

A front surface and a rear surface of the buckle body 1 are curved surfaces. A first elongated hole 6 is provided at an upper end of the buckle body 1, and a second elongated hole 7 is provided at a lower end of the buckle body 1. An axis of the first elongated hole 6 is oblique along a left-and-right direction, and an axis of the second elongated hole 7 is oblique along the left-and-right direction. An end of the first elongated hole 6 close to the pin shaft 3 is close to a human body in use, and an end of the second elongated hole 7 close to the pin shaft 3 is close to a human body in use. As shown in FIGS. 1 and 6, a first sliding groove 4 is provided on an upper part of a back of the buckle body 1, and a second sliding groove 5 is provided on a lower part of the back of the buckle body 1. The first sliding groove 4 and the second sliding groove 5 have the same width and are arranged along the left-and-right direction.

Figure 2:
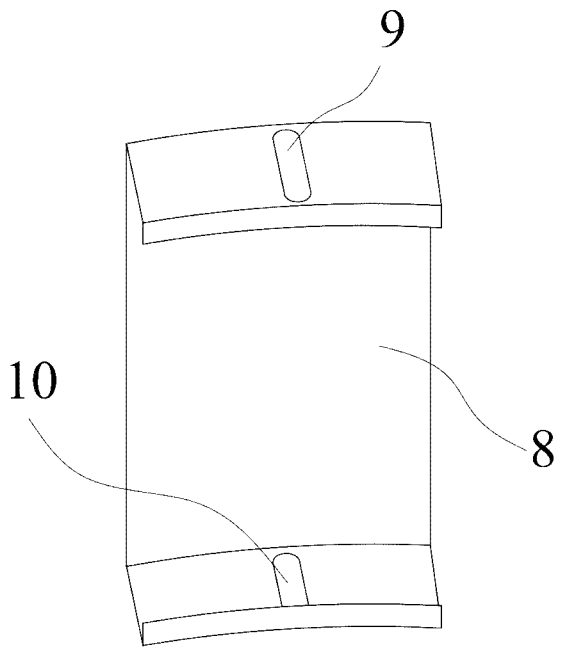
FIG. 2 schematically depicts a structure of a first clamp plate.

The first clamp plate 8 is arranged behind the buckle body 1. A height of the first clamp plate 8 is slightly smaller than a distance from a bottom of the second sliding groove 5 to a top of the first sliding groove 4, and a width of the first clamp plate 8 is slightly smaller than the width of the first sliding groove 4 and the second sliding groove 5. As shown in FIG. 2, a third elongated hole 9 is arranged at a middle of an upper end of the first clamp plate 8, and a fourth elongated hole 10 is arranged at a middle of a lower end of the first clamp plate 8. An axis of the third elongated hole 9 is arranged along a front-and-back direction, and an axis of the fourth elongated hole 10 is arranged along the front-and-back direction. As shown in FIGS. 5-6, the upper end of the first clamp plate 8 is embedded in the first sliding groove 4 and is slidable along the left-and-right direction, and the lower end of the first clamp plate 8 is embedded in the second sliding groove 5 and is slidable along the left-and-right direction. A front surface of the first clamp plate 8 abuts against a back surface of the buckle body 1 and is slidable along the left-and-right direction. The upper end and the lower end of the first clamp plate 8 are easily slidable along the left-and-right direction in the first sliding groove 4 and the second sliding groove 5, respectively.

Figure 3:
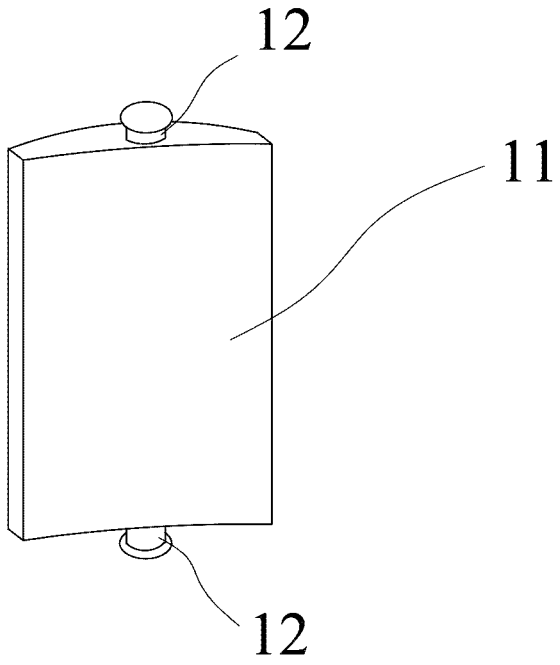
FIG. 3 schematically depicts a structure of a second clamp plate.
Figure 4:
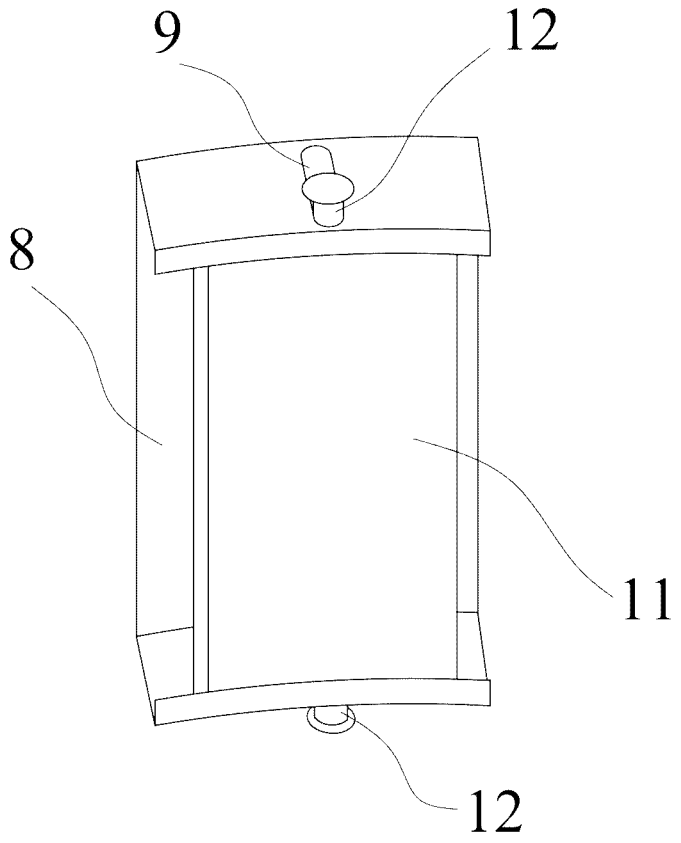
FIG. 4 schematically depicts a combination of the first clamp plate and the second clamp plate.

As shown in FIG. 3, the second clamp plate 11 is arranged behind the first clamp plate 8, and a vertical shaft 12 is arranged at a middle of the second clamp plate 11. A height of the second clamp plate 11 is slightly smaller than a height between the upper end and the lower end of the first clamp plate 8. As shown in FIGS. 4-5, an upper end of the vertical shaft 12 is inserted into the third elongated hole 9 and the first elongated hole 6, and a lower end of the vertical shaft 12 is inserted into the fourth elongated hole 10 and the second elongated hole 7. The vertical shaft 12, the third elongated hole 9 and the fourth elongated hole 10 are together configured to control the first clamp plate 8 and the second clamp plate 11 to slide synchronously in the first sliding groove 4 and the second sliding groove 5. The vertical shaft 12, the first elongated hole 6 and the second elongated hole 7 are together configured to control the second clamp plate 11 to move close to or away from the first clamp plate 8 during a synchronous sliding along the left-and-right direction.

When the belt 13 is fastened, a movable end of the belt 13 is inserted between the first clamp plate 8 and the second clamp plate 11 from right to left by means of a right hand of a user. A tightness of the fastening is adjusted, and then the vertical shaft 12 is slid to the right by a hand, such that the first clamp plate 8 and the second clamp plate 11 together clamp the belt 13 to slide synchronously to the right in the first sliding groove 4 and the second sliding groove 5. Meanwhile, the vertical shaft 12 moves forward along the first elongated hole 6 and the second elongated hole 7 to drive the second clamp plate 11 move forward such that the second clamp plate 11 and the first clamp plate 8 clamp the belt 13. When the belt 13 is untied, the buckle body 1 is fixed by the right hand, and the movable end of the belt 13 is pulled to the left by a left hand, such that the belt 13 drives the first clamp plate 8 and the second clamp plate 11 to slide synchronously to the left along the first sliding groove 4 and the second sliding groove 5. Meanwhile, the vertical shaft 12 moves backward and leftward in the first elongated hole 6 and the second elongated hole 7 to drive the second clamp plate 11 to move backward such that the second clamp plate 11 and the first clamp plate 8 are separated. Then the buckle body 1 is held by the left hand, and the movable end of the belt 13 is pulled out from between the first clamp plate 8 and the second clamp plate 11 by the right hand.

In some embodiments, the front surface and the rear surface of the buckle body 1 are flat surfaces. The first sliding groove 4 and the second sliding groove 5 of the buckle body 1 are straight grooves. The front surface of the first clamp plate 8 is a flat surface. The upper end and the lower end of the first clamp plate 8 are linear. A front surface of the second clamp plate 11 is a flat surface.

In some embodiments, the first elongated hole 6 and the second elongated hole 7 are of an arc structure.

In some embodiments, rear margin plates of the first sliding groove 4 and the second sliding groove 5 can extend downward and upward to integrally form a plate.

In some embodiments, the front surface of the second clamp plate 11 is processed into a vertical corrugated surface to increase friction.

What is claimed is:

1. A clip-on belt buckle, comprising:

a buckle part;

a connecting part; and a pin shaft;

wherein a fixed end of a belt is fixed on the connecting part; the buckle part is movably connected to the connecting part by the pin shaft; the buckle part comprises a buckle body; a first elongated hole is provided at an upper end of the buckle body; a second elongated hole is provided at a lower end of the buckle body; an axis of the first elongated hole is oblique along a left-and-right direction; an axis of the second elongated hole is oblique along the left-and-right direction; an end of the first elongated hole close to the pin shaft is close to a human body in use; an end of the second elongated hole close to the pin shaft is close to the human body in use; a first sliding groove is provided on a upper part of a back of the buckle body; a second sliding groove is provided on a lower part of the back of the buckle body; the first sliding groove and the second sliding groove have the same width and are arranged along the left-and-right direction;

a first clamp plate is arranged behind the buckle body; a third elongated hole is arranged at a middle of an upper end of the first clamp plate; a fourth elongated hole is arranged at a middle of a lower end of the first clamp plate; an axis of the third elongated hole is arranged along a front-and-back direction; an axis of the fourth elongated hole is arranged along the front-and-back direction; the upper end of the first clamp plate is embedded in the first sliding groove and is slidable along the left-and-right direction; the lower end of the first clamp plate is embedded in the second sliding groove and is slidable along the left-and-right direction; a front surface of the first clamp plate abuts against a back surface of the buckle body and is slidable along the left-and-right direction; a second clamp plate is arranged behind the first clamp plate; a vertical shaft is arranged at a middle of the second clamp plate; an upper end of the vertical shaft is inserted into the third elongated hole and the first elongated hole; a lower end of the vertical shaft is inserted into the fourth elongated hole and the second elongated hole; the vertical shaft, the third elongated hole and the fourth elongated hole are together configured to control the first clamp plate and the second clamp plate to slide synchronously in the first sliding groove and the second sliding groove; the vertical shaft, the first elongated hole and the second elongated hole are together configured to control the second clamp plate to move close to or away from the first clamp plate during a synchronous sliding along the left-and-right direction;

when the belt is fastened, a movable end of the belt is inserted between the first clamp plate and the second clamp plate from right to left by means of a right hand of a user, and a tightness of the fastening is adjusted; the vertical shaft is slid to the right by a hand, such that the first clamp plate and the second clamp plate clamps the belt to slide synchronously to the right in the first sliding groove and the second sliding groove; meanwhile, the vertical shaft moves forward along the first elongated hole and the second elongated hole to drive the second clamp plate to move forward such that the second clamp plate and the first clamp plate clamp the belt;

when the belt is untied, the buckle body is fixed by the right hand, and the movable end of the belt is pulled to the left by a left hand, such that the belt drives the first clamp plate and the second clamp plate to slide synchronously to the left along the first sliding groove and the second sliding groove; meanwhile, the vertical shaft moves backward in the first elongated hole and the second elongated hole to drive the second clamp plate to move backward such that the second clamp plate and the first clamp plate are separated; then the buckle body is held by the left hand, and the movable end of the belt is pulled out from between the first clamp plate and the second clamp plate by the right hand.

* * * * *